US005203095A

United States Patent [19]

Allen

[11] Patent Number: 5,203,095

[45] Date of Patent: Apr. 20, 1993

[54] ORTHOPEDIC STABILIZER ATTACHMENT AND SHOE

[76] Inventor: Don T. Allen, 4406 Oxford Way, Norman, Okla. 73072

[21] Appl. No.: 900,470

[22] Filed: Jun. 18, 1992

Related U.S. Application Data

[63] Continuation-in-part of Ser. No. 743,890, Aug. 12, 1991, Pat. No. 5,159,767, which is a continuation-in-part of Ser. No. 535,604, Jun. 11, 1990, abandoned.

[51] Int. Cl.[5] ..... A43B 21/30; A43B 21/32

[52] U.S. Cl. ..... 36/27; 36/38

[58] Field of Search ..... 36/38, 27, 7.8, 35 R, 36/37

[56] References Cited

U.S. PATENT DOCUMENTS

| | | |
|---|---|---|
| 1,102,343 | 7/1914 | Kovacs . |
| 1,625,048 | 4/1927 | Nock . |
| 2,447,603 | 8/1948 | Snyder . |
| 2,508,318 | 5/1950 | Wallach et al. . |
| 2,548,308 | 4/1951 | Hensley . |
| 3,886,674 | 6/1975 | Pavia . |
| 4,492,046 | 1/1985 | Kosova . |
| 4,534,124 | 8/1985 | Schnell . |
| 4,566,206 | 1/1986 | Weber . |
| 4,592,153 | 6/1986 | Jacinto . |
| 4,771,554 | 9/1988 | Hanneman . |
| 4,941,272 | 7/1990 | Allen . |
| 5,159,767 | 11/1992 | Allen ..... 36/27 |

FOREIGN PATENT DOCUMENTS

| | | |
|---|---|---|
| 1169599 | 7/1985 | U.S.S.R. . |
| 8000781 | 5/1980 | World Int. Prop. O. . |

*Primary Examiner*—Steven N. Meyers

*Attorney, Agent, or Firm*—Wigman & Cohen

[57] ABSTRACT

An improved arch support device and shoe incorporating such device. A device and shoe incorporating the device is disclosed which include rigid members for supporting and distributing weight along the foot both forward and rearward away from the arch and a flexible member for cushioning the heel region of the shoe during standing, walking or other movement.

32 Claims, 4 Drawing Sheets

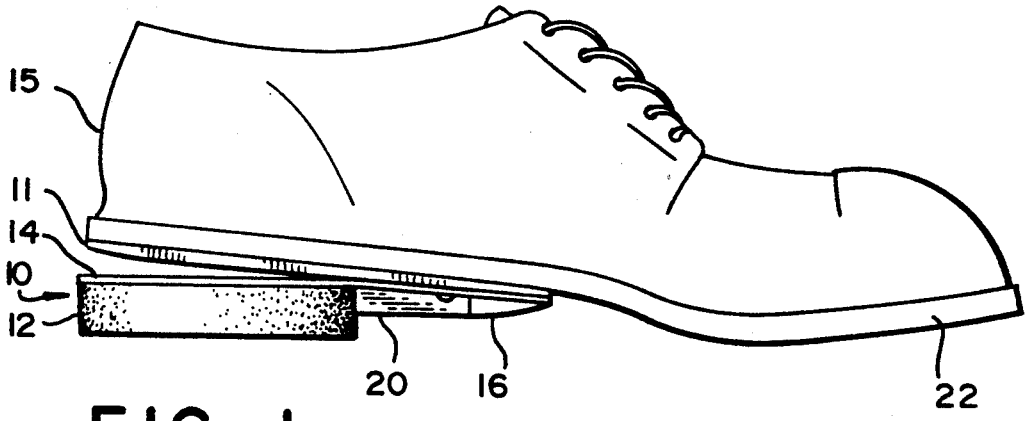
FIG. 1
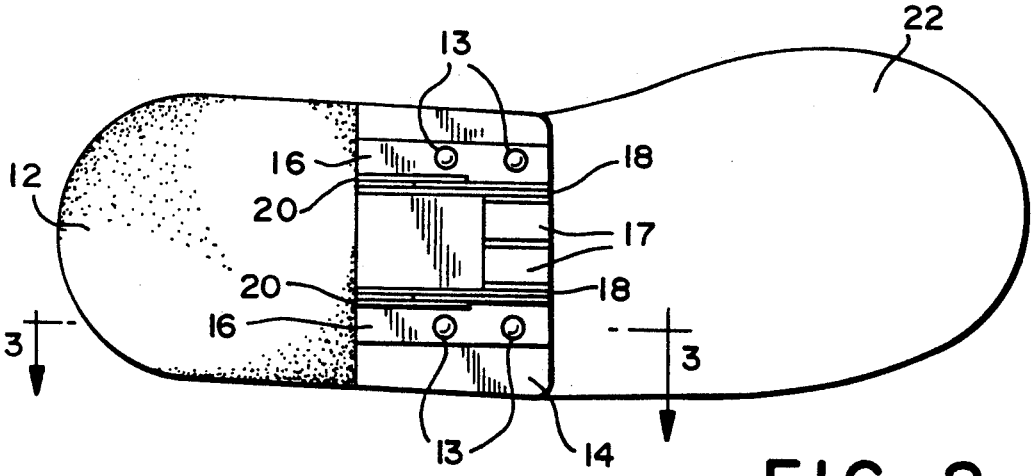
FIG. 2
FIG. 3
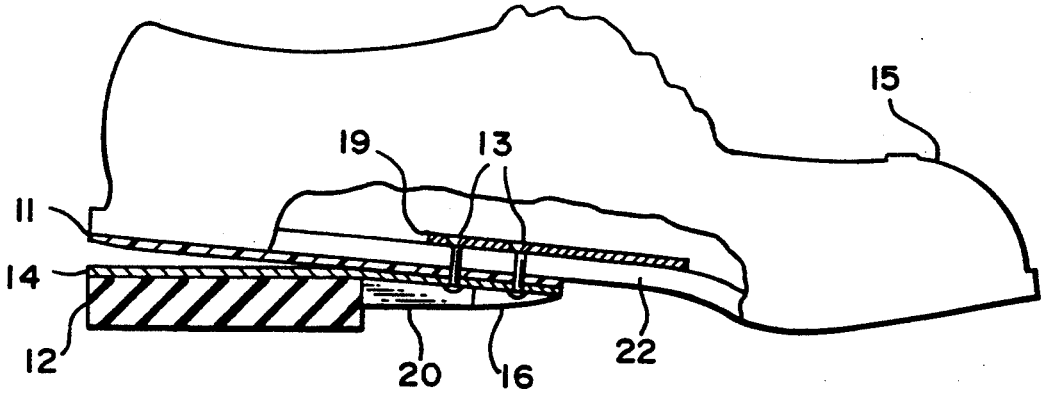

ORTHOPEDIC STABILIZER ATTACHMENT AND SHOE

CROSS-REFERENCE TO RELATED APPLICATION

This application is a continuation-in-part of U.S. application Ser. No. 07/743,890, filed Aug. 12, 1991, now U.S. Pat. No. 5,159,767 which is, in turn, a continuation-in-part of U.S. application Ser. No. 07/535,604 filed Jun. 11, 1990 now abandoned.

BACKGROUND OF THE INVENTION

1. Field of the Invention

The present invention is directed to shoes worn by humankind, and more particularly to the support the shoes provide for the foot.

2. Description of the Prior Art

Shoes worn by men and women of all ages have been designed for the most part with a sole attached to the bottom of the shoe and a heel on the back one-fourth of the shoe attached to the sole. The heel provides lift and cushions the front part of the foot when walking. Some shoes provide arch support in the area under the arch of the foot. The normal arch of the foot is strong enough to balance the weight of the body on the front part of the foot and the back (heel) of the foot. When the first metatarsal, cuneiform, scaphoid and astragalus bones of the foot are not connected properly, the arch falls and the proper balance is not maintained.

There is then more pressure placed on the heel and less pressure on the front of the foot thereby causing improper balance. This can bring about pain to the heel.

Various products have been on the market for several years to alleviate this problem. One is the arch support. This device, sometimes padded, is placed in the shoe to keep the arch higher when standing or walking. In many cases this is beneficial; however, it does not balance the foot completely and more than normal pressure is usually placed on the heel causing discomfort to the heel. The other most common product is the padded sole placed in the shoe. This device also helps in some cases but does nothing to balance the foot and relieve excess pressure on the heel. Many people of various occupations are required to stand on their feet for long periods of time If they have fallen arches they will in most cases have discomfort to their feet.

A number of prior art patents are directed to providing cushioned soles and cushioned heels. Typical among these patents is U.S. Pat. No. 4,566,206 to Weber which is directed to a wedged heel structure which serves as an undamped spring having multi-spring rates. The Weber structure is essentially resilient and one piece and does not provide rigid support of the arch, with a distribution of force toward the ball of the foot. In addition, U.S. Pat. No. 1,625,048 to Nock is directed to a spring heel, as is U.S. Pat. No. 1,102,343 to Kovacs and U.S. Pat. No. 3,886,674 to Pavia. However, none of these patents is directed to providing arch support.

SUMMARY AND OBJECTS OF THE INVENTION

The present invention provides a better balance to the foot when walking or standing. While walking the first contact to floor or ground is made by the extended heel. This same condition takes place while standing.

If the shoe used with the orthopedic stabilizer attachment has a heel, the heel must be removed when the attachment is installed and then replaced.

The arch stabilizer plate is stabilized, therefore holding up the arch. At the same time, the heel of the foot is cushioned by the resin spring plate allowing the heel and heel area of the shoe to come down and bring about balance to the foot.

The present invention is directed to an orthopedic apparatus and shoe incorporating the apparatus including a structure which cooperates to distribute weight from the arch area of the foot toward the heel and also toward the ball of the foot. This is accomplished by a combination of rigid and flexible members which cooperate with each other and the foot of the wearer. More particularly, in first and second embodiments, a first rigid reinforcing member is disposed inside of the shoe and located under the arch region of the foot and extends in the direction of the ball of the foot. A flexible supporting member is attached to the bottom of the shoe. A second rigid mounting member extends at an acute angle from the flexible member with the apex at the arch region back toward the heel region and forms the base for mounting of the heel to the shoe if a heel is to be provided. The flexible member, the second rigid member and the inside first rigid member are commonly attached by fasteners such as bolts or pop rivets in the arch region. The result is a pivot axis substantially transverse to the longitudinal axis of the shoe. The flexible member functions as a spring plate which is compressed toward the second rigid member. This serves to support and cushion the heel region of the foot. The first rigid member, extending forwardly toward the ball of the foot, in cooperation with the flexible spring member and second rigid member, serves to provide arch support and to distribute weight over the length of the foot.

In a third embodiment of the orthopedic apparatus, the first rigid reinforcing member is eliminated from the inside of the shoe and replaced by a rigid reinforcing member in the form of a sole wedge which is disposed forward of the apex formed by the acute-angle connected mounting member and supporting member. The acute angle is maintained by a wedge disposed between the mounting member and supporting member. In the third embodiment, the apparatus is attached or bonded to an inner sole and an outer sole is placed over the orthopedic apparatus and bonded to the apparatus and the inner sole. A heel, also bonded to the apparatus, can be provided, or, alternatively, the heel can be eliminated.

In the second and third embodiments, a reinforced resin is used to provide either a flexible plate or a substantially rigid plate, depending upon the number of laminations of vinyl ester resin and graphite fabric employed.

BRIEF DESCRIPTION OF THE DRAWINGS

FIG. 1 is a side view of a first embodiment of the orthopedic stabilizer attachment and shoe.

FIG. 2 is a bottom view of the first embodiment of the orthopedic stabilizer attachment and shoe.

FIG. 3 is a side and partial cross-sectional view of the first embodiment of the orthopedic stabilizer attachment and shoe.

DETAILED DESCRIPTION OF THE PREFERRED EMBODIMENTS

Figure 4:
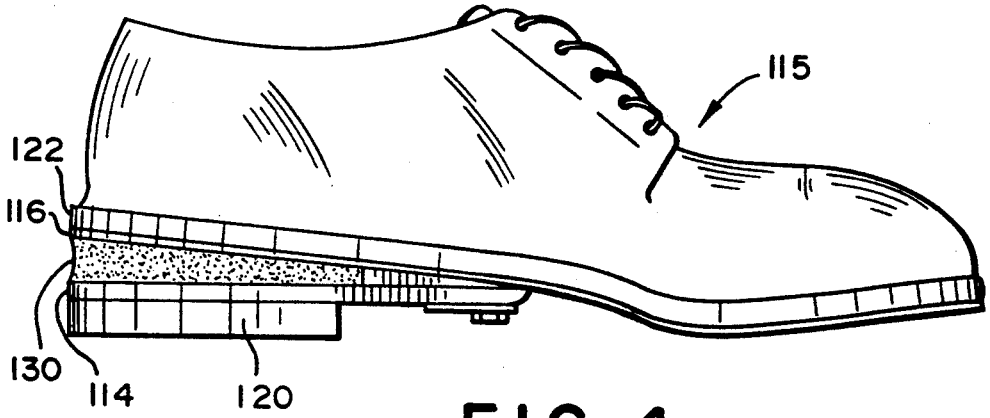
FIG. 4 is a side view of a second embodiment of the orthopedic stabilizer attachment and shoe.

Referring now to the drawings wherein like numerals indicate like elements throughout the several views, FIG. 1-3 illustrate a first preferred embodiment of an orthopedic stabilizer attachment of the present invention, generally designated 10. This attachment can be installed on most oxford-type shoes, boots, tennis shoes, loafer-type shoes, sandals or any apparatus or apparel worn on the human foot and is especially useful for individuals with fallen arches, or as they are more commonly called, "flat feet." All of the above foot apparel will hereafter be generically referred to as "shoe." If the shoe has a heel, the heel must be removed, the orthopedic stabilizer attachment installed, and then the heel replaced.

As shown in FIGS. 1-3, a first embodiment of the orthopedic stabilizer attachment 10 comprises a flexible reinforced resin spring plate 11, a rubber or nylon heel 12, and four 3/16 inch steel pop rivets 13.

An arch stabilizer plate 14 is fabricated preferably from titanium plate having a thickness of 0.040 inches. Other equivalent materials may be substituted. Thicker titanium may be used for heavy individuals or for people that would be carrying heavy objects while wearing the orthopedic stabilizer attachment 10 of the present invention. The arch stabilizer plate 14 is cut in a pattern to match the back half of the shoe 15. The arch stabilizer plate 14 is then bent downward one-third of the distance from the front of the arch stabilizer plate 14. The degree of the bend is 2 degrees to 30 degrees, depending upon the size of the shoe and the weight of the wearer.

Two outside reinforcing ½ inch 90 degree angles 16 made from titanium plate of 0.040 inch thickness are then spot-welded on one side of the outside reinforcing angle 16 to the arch stabilizer plate 14. They run lengthwise from the front to ¼ inch from the back heel end and are 1 inch apart. The outside reinforcing angles 16 are cut through the side perpendicular to the arch stabilizer plate 14, ½ inch. The cut is 3/16 inch wide. This cut allows the outside reinforcing angles 16 to bend and conform to the already bent arch stabilizer plate 14. Two inside reinforcing ½ inch 90 degree angles 17, 1 inch long, are then spot-welded on one side of the inside reinforcing angles 17 to the front end of the arch stabilizer plate 14 on the inside of the outside reinforcing angles 16. Two inside angle strengtheners 18, 2½ inch × 3/8 inch made from 0.040 inch thick titanium plate are inserted vertically to the arch stabilizer plate 14 between the longer outside reinforcing angles 16 and the shorter inside reinforcing angles 17. The longer outside reinforcing angles 16, inside reinforcing angles 17 and the inside angle strengtheners 18 are even with the front of the arch stabilizer plate 14 and are spot-welded together.

Two outside angle strengtheners 20, 1½ inch long by ⅜ inch wide made from 0.040 inch thick titanium plate are spot-welded over the 3/16 inch cut on the vertical side of the outside reinforcing angles 16. The outside angle strengtheners 18 are centered over the 3/16 inch cut.

Four 3/16 inch holes are drilled through the arch stabilizer plate 14. The holes are two on each side of the arch stabilizer plate 14. The centers of two of the holes are ½ inch back from the front end of the arch stabilizer plate 14 and ¾ inch out from the centerline end to the end of the arch stabilizer plate 14. The centers of the other two holes are drilled 1 ¼ inch back of the front end of the arch stabilizer plate 14 and ¾ inch out from the centerline end to end of the arch stabilizer plate 14.

Reinforced resin spring plate 11 is molded and cut to act as a spring to separate the sole 22 from the arch stabilizer plate 14. The thickness of the reinforced resin spring plate 11 will be determined by the weight of the wearer.

Four holes are drilled the same way as the arch stabilizer plate 14 in the reinforced resin spring plate 11.

Four holes are drilled through the sole 22 of the shoe 15 using the arch stabilizer plate 14 as a pattern. The round end of the arch stabilizer plate 14 will be even with the back end of the sole 22.

A 2½ inch × 2½ inch sole strengthener plate 19 made from 0.040 inch thick titanium plate is placed inside the shoe 15 on top of the sole 22 arch area. This plate has four holes drilled in it that match the holes in the arch stabilizer plate 14 and the reinforced spring plate 11. The centers of the holes are drilled ¼ inch from the back end of the sole strengthener plate 19.

The arch stabilizer plate 14, reinforced resin spring plate 11, sole strengthener plate 19 and the shoe 15 are connected together with four steel pop rivets 13. The length of the pop rivets 13 will be determined by the thickness of the sole 22 and the thickness of the reinforced resin spring plate 11 which will be determined by the weight of the wearer.

The front part of the orthopedic stabilizer attachment 10 is trimmed as shown in FIGS. 1 and 3 to prevent the orthopedic stabilizer attachment 10 from dragging while walking.

A rubber or nylon heel is glued to the completed arch stabilizer plate 14. Grooves are cut in the heel 12 to allow for the outside reinforcing angles 16. The outside reinforcing angles 16 are trimmed to ⅜ inch vertical drop after completion of the arch stabilizer plate 14.

In operation, the flexible resin spring plate 11 and the rigid arch stabilizer plate 14 are joined at an acute angle with a pivot axis located at approximately the line of most rearward contact between the members. This provides a spring flexure for the heel of the wearer's foot. The rigid sole strengthener plate 19 extending forwardly from the area of attachment by pop rivets 13 supports the arch of the foot, in cooperation with the combination of the arch stabilizer plate 14 and the resin spring plate 11.

Figure 5:
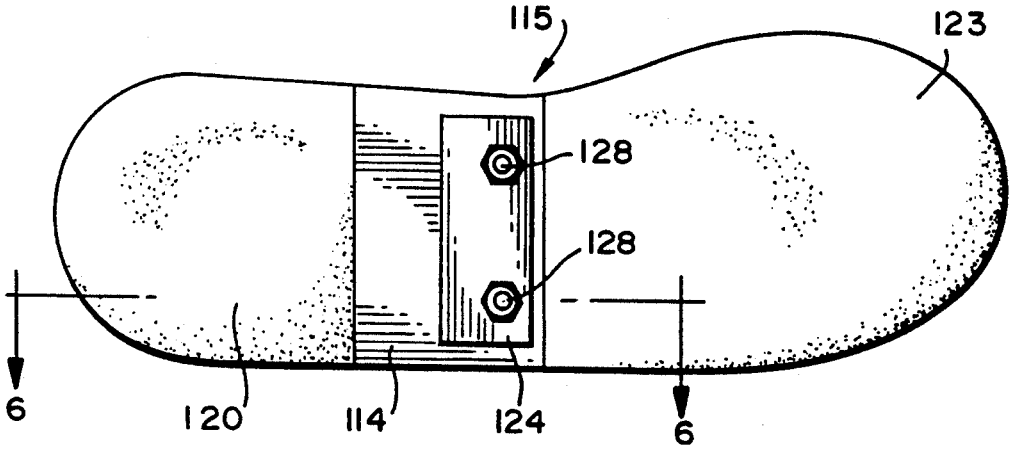
FIG. 5 is a bottom view of the second embodiment of the orthopedic stabilizer attachment and shoe.
Figure 6:
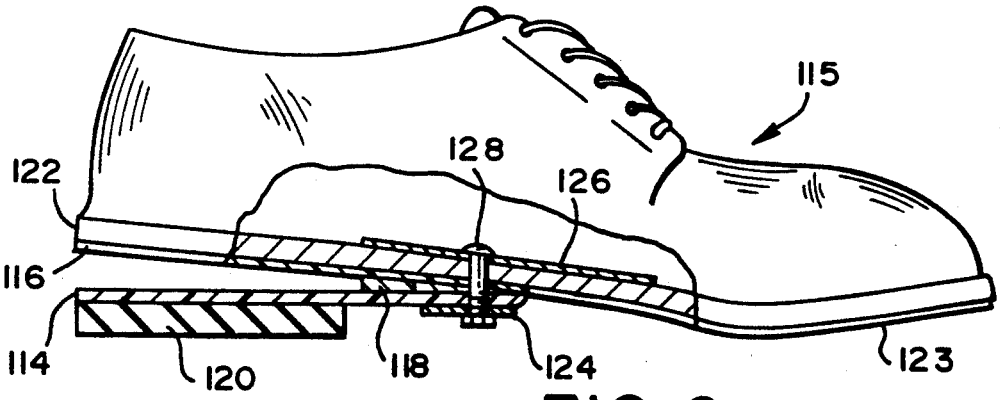
FIG. 6 is a side and partial cross-sectional view of the second embodiment of the orthopedic stabilizer attachment and shoe.
Figure 7:
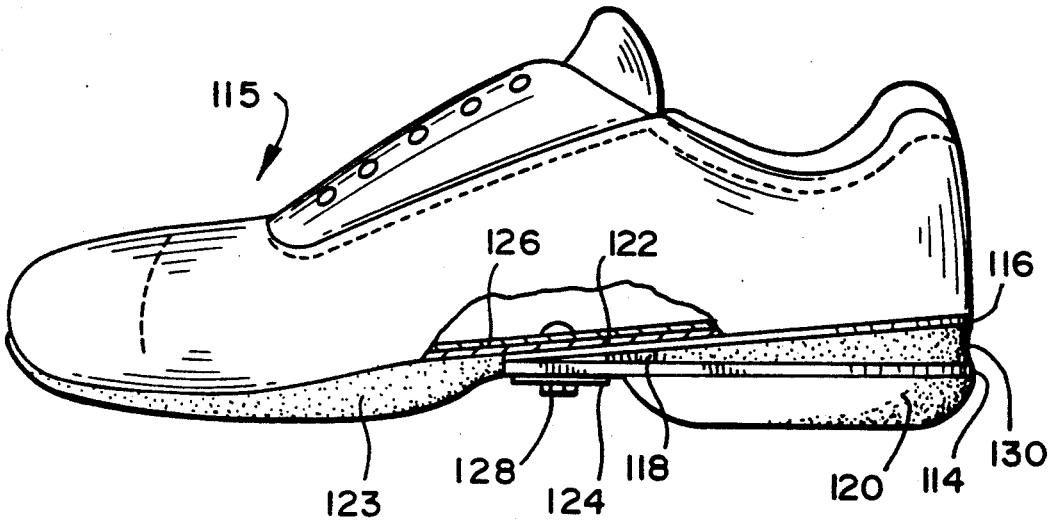
FIG. 7 is a side and partial cross-sectional view of a second embodiment of the orthopedic stabilizer attachment incorporated in an athletic shoe.

FIGS. 4-6 illustrate a second preferred embodiment using a combination of rigid plates, a flexible plate and a wedge which provide the desired support discussed above. FIG. 7 illustrates the second preferred embodiment in a sneaker or other athletic shoe.

As shown in FIGS. 4-6, a shoe 115 incorporating the present invention in a standard dress or oxford style is constructed as follows: a rigid resin arch stabilizer plate 114 is provided and held in contact with a flexible resin spring plate 116. The rigid resin arch stabilizer plate 114 and flexible resin spring plate 116 are held apart by an adjusting wedge 118 which maintains the relative angular orientation between the two resin plates. Heel 120 is mounted on rigid resin arch stabilizer spring plate 114. Flexible resin spring plate 116 is mounted flush with sole 122. Sole strengthener plate 126 and arch strengthener plate 124 are mounted such that the plates overlap around the region where the rigid resin plate 114 and the flexible resin spring plate 116 come together.

Sole strengthener plate 126 and rigid resin arch stabilizer plate 114 are commonly attached by a plurality of fasteners 128, preferably bolts or pop rivets. For a more streamlined appearance, plates 124, 126 can be welded using an intermediate rod. Sole strengthener plate 126 and arch strengthener plate 124 are preferably made of titanium plate or its equivalent. Arch strengthener plate 124 and sole strengthener plate 126 are dimensioned so as to provide proper support for fasteners 128. Sole strengthener plate 126 is dimensioned and positioned so as to extend forwardly from the arch of the foot toward the ball of the foot. A foam insert 130 is used for styling purposes and to provide a small degree of additional support and resiliency. Wedge 118 is adjustable by moving forwardly and/or rearwardly along the longitudinal axis of the shoe, to provide proper support, depending upon the weight of the wearer of the shoe.

FIG. 7 shows the second embodiment mounted in a tennis shoe or sneaker. The elements are numbered corresponding to the elements of FIGS. 4–6. The materials used and dimensions employed are adjusted in accordance with standard practices in the athletic shoe industry.

As in the first embodiment, the arch stabilizer plate 114 and the spring plate 116 are dimensioned so as to conform to the contours of the sole 122 of the shoe. As constructed, the shoe 115 can include a further layer of material (not shown) on the front sole in the ball of the foot region.

The preferred dimensions and materials are as follows for a size 9½ shoe of the second embodiment: arch strengthener plate 124 is approximately 2¼ inch wide and 1 inch long and is made of 6AL/4V grade titanium plate of 0.040 inch thickness. Sole strengthener plate 126 is made of the same grade and thickness titanium, but is approximately 3 inch long and 2¼ inch wide. Flexible resin spring plate 116 and rigid resin arch stabilizer plate 114 are each of approximately the same dimensions, with the flexible resin spring plate 116 having a thickness of approximately 0.110 inch and the rigid resin arch stabilizer plate 114 having a thickness of approximately 0.225 inch, a length of 5¼ inches and a width of approximately 3 inches on a size 9½ C shoe. The sole strengthener plate 126 and the two resin plates 114, 116 are aligned to overlap and be attached such that the combined length is approximately 7¼ inches for a size 9½ shoe.

The rigid resin used in arch stabilizer plate 114, and the flexible resin used in spring plate 116 are each preferably made from DERAKANE 8084 resin, a vinyl ester resin manufactured by Dow Chemical Company, using approximately 2.5 weight percent methyl ethyl ketone peroxide as a catalyst, approximately 0.40 weight percent cobalt naphthenate as a promoter, and approximately 0.10 weight percent dimethylaniline as an accelerator.

The rigid and flexible resins differ in the degree of reinforcement and lamination. The rigid resin is reinforced and laminated with approximately twenty layers of Hexcel Corporation graphite fabric having #716 fabric style plain weave, 4.7 ozs. per square yard weight, 0.006 inch thickness, 16×16 warp fill, 3 k warp, 75 1/0 fill yarn, undirectional graphite fabric-glass fill. The graphite fabric is laid such that all twenty sheets run the length of the rigid resin plate. The flexible resin plate is also DERAKANE 8084, reinforced with approximately ten sheets of Hexcel graphite fabric. The result is that the rigid resin plate has a thickness of approximately 0.225 inch, whereas the flexible plate has a thickness of approximately 0.110 inch. The sole of the shoe is standard leather or synthetic. A leather insert may be used to cover the sole strengthener plate 124. Foam insert 130 is typically closed cell, ethylene vinyl acetate having a compression deflection in the range of 3.5 to 6.5 psi and a density of 2.5 to 3.5 lb/cu. ft.

Adhesives, as known in the shoe art, are used for attaching the plates, soles, inserts, heel, and so forth, together.

The dimensions of the members can be adjusted slightly to accommodate different shoe sizes. The size described above corresponds to a 9½ size shoe. Appropriate adjustment is made by taking into account that each ½ shoe size corresponds to ¼ inch in foot length. The overall length of arch stabilizer plate 114, flexible spring plate 116 and sole strengthener plate 126 is to be increased or decreased by ⅛ inch for each change of ½ shoe size.

Figure 8:
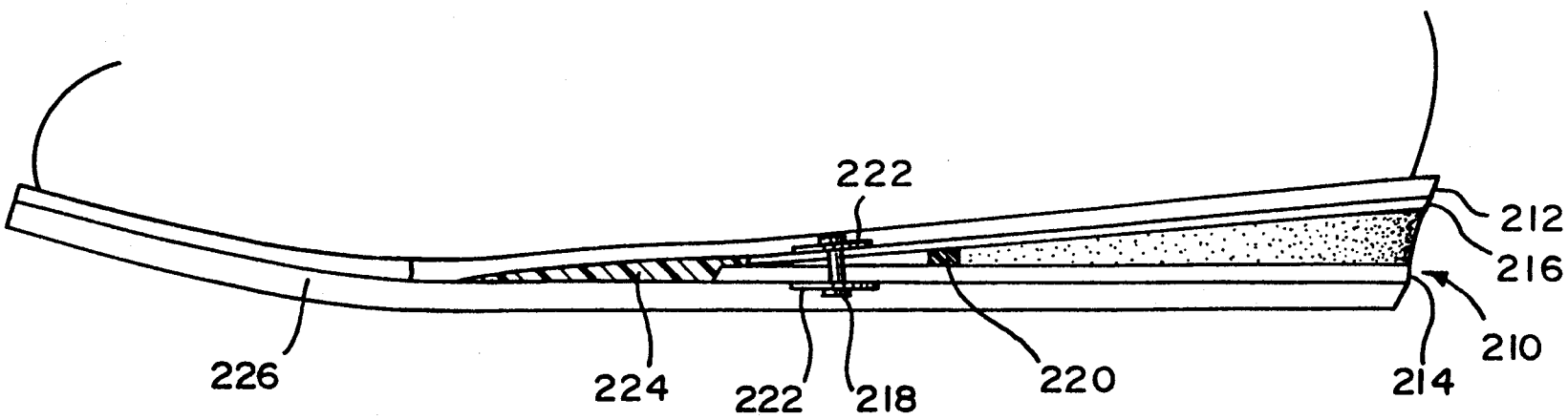
FIG. 8 is a side and partial cross-sectional view of a third embodiment of the orthopedic stabilizer attachment.

A third embodiment of the invention is shown in FIG. 8. The advantage of this embodiment is that the entire orthopedic stabilizer attachment structure 210 is applied to the outside of inner sole 212, rather than having a metal plate and fastener protruding into the inside of the shoe. The third embodiment includes a rigid resin arch stabilizer plate 214 and a flexible resin spring plate 216 which are attached by a fastener such as a pop rivet or bolt 218. The acute angular separation between the arch stabilizer plate 214 and spring plate 216 is maintained by a wedge 220. Wedge 220 is preferably fixed, but may also be longitudinally adjustable. A pair of opposedly mounted arch strengthener plates 222 provide support for the fastener 218. Disposed in front of the apex of the combined arch stabilizer plate 214 and spring plate 216 is a substantially rigid sole wedge 224 which is located beneath the arch region of the foot. This entire structure is disposed between an inner sole 212 and outer sole 226. Adhesives or other means of attachment known in the shoe art bond the orthopedic apparatus 210 to the inner sole 212. A lower sole 226, approximately 2/8 inch thick is bonded to the bottom of the orthopedic apparatus 210 and the portion of the inner sole 212 in front of the orthopedic apparatus 210. Foam member 230 is disposed, for substantially cosmetic purposes, between arch stabilizer plate 214 and spring plate 216. A replaceable heel 228 is bonded to the bottom of the orthopedic apparatus 210, as shown, or to the lower sole 226 if the sole 226 extends the length of the shoe (not shown). Alternatively, the shoe heel can be eliminated (not shown).

The third embodiment is comprised of materials similar to the second embodiment. The arch stabilizer plate 214 is made of the same resin laminate as the arch stabilizer plate 114 of the second embodiment Similarly, the spring plate 216 is made of the same resin laminate as the spring plate 116 of the second embodiment. The sole wedge 224 and wedge 220 are made of the same rigid resin as the arch stabilizer plate 214. The dimensions of the spring plate 216 and arch stabilizer plate 214 are substantially the same as the corresponding elements in the second embodiment. The arch strengthener plates 222, are preferably of titanium, 0.040 inch thickness, 2¼ inches wide and 1 inch long. The sole wedge 224 is approximately 1.5 to 3 inches long, depending upon shoe size and having the same width as the sole.

The third embodiment works as follows:

Sole wedge 224 provides support under the arch region of the foot and serves to distribute weight forward toward the ball region. The spring plate 216 flexes toward arch stabilizer plate 214. This serves to cushion and support the heel of the foot. Thus the elements cooperate to provide arch support and to distribute weight over the length of the foot.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. An orthopedic apparatus for use on a shoe having a sole portion said orthopedic apparatus comprising, a region corresponding to the heel of a human foot, a region corresponding to the arch of a human foot, and a region corresponding to the ball of a human foot said apparatus, comprising:

a substantially rigid first member extending from the arch region backward toward the heel region;

a substantially flexible supporting member extending from the arch region backward toward the heel region;

a fastener located in said arch region and fastening said first member and said supporting member together;

a wedge, for maintaining a separation between said supporting member and said first member, said separation terminating at an apex;

a substantially rigid wedge-shaped reinforcing member extending from the arch region forward to the ball region and reinforcing the sole portion of the shoe, said reinforcing member disposed in front of said apex;

whereby said first member, said supporting member and said reinforcing member cooperate to distribute weight forward toward said ball region and rearward toward said heel region and said supporting member flexes toward said first member to thereby cushion said heel region.

2. An orthopedic apparatus as in claim 1, wherein said wedge is fixed.

3. An orthopedic apparatus as in claim 1, wherein said substantially rigid first member is a rigid resin arch stabilizer plate.

4. An orthopedic apparatus as in claim 1, wherein said substantially flexible supporting member is a flexible resin spring plate.

5. An orthopedic apparatus as in claim 1, wherein said fastener comprises at least one bolt.

6. An orthopedic apparatus as in claim 1, wherein said fastener comprises at least one rivet.

7. An orthopedic apparatus as in claim 1, wherein said reinforcing member is a sole wedge.

8. An orthopedic apparatus as in claim 1, wherein said substantially rigid first member comprises a plastic resin reinforced with a plurality of fabric layers.

9. An orthopedic apparatus as in claim 8, wherein said reinforced plastic resin comprises a vinyl ester resin and said reinforcing fabric layers comprise a material taken from the group consisting of graphite and glass fibers.

10. An orthopedic apparatus as in claim 1, wherein said substantially flexible supporting member comrises a plastic resin reinforced with a plurality of fabric layers.

11. An orthopedic apparatus as in claim 10, wherein said reinforced plastic resin comprises a vinyl ester resin and said reinforcing fabric layers comprise a material taken from the group consisting of graphite and glass fibers.

12. An orthopedic apparatus as in claim 1, wherein said wedge comprises a plastic resin reinforced with a plurality of fabric layers.

13. An orthopedic apparatus as in claim 12, wherein said reinforced plastic resin comprises a vinyl ester resin and said reinforcing fabric layers comprise a material taken from the group consisting of graphite and glass fibers.

14. An orthopedic apparatus as in claim 1, wherein said wedge-shaped reinforcing member comprises a plastic resin reinforced with a plurality of fabric layers.

15. An orthopedic apparatus as in claim 14, wherein said reinforced plastic resin comprises a vinyl ester resin and said reinforcing fabric layers comprise a material taken from the group consisting of graphite and glass fibers.

16. An orthopedic apparataus as in claim 1, further comprising a heel mounted on said first member.

17. An orthopedic shoe comprising:

an upper portion for encompassing a human foot, and a sole portion, said portions forming a region corresponding to the heel of a human foot, a region corresponding to the arch of a human foot, and a region corresponding to the ball of a human foot;

a substantially rigid first member extending from the arch region backward toward the heel region;

a substantially flexible supporting member extending from the arch region backward toward the heel region;

a fastener located in said arch region and fastening said first member and said supporting member together;

a wedge for maintaining a separation between said supporting member and said first member, said separation terminating at an apex;

a substantially rigid wedge-shaped reinforcing member extending from the arch region forward to the ball region and reinforcing the sole portion of the shoe, said reinforcing member disposed in front of said apex;

whereby said first member, said supporting member and said reinforcing member cooperate to distribute weight forward toward said ball region and rearward toward said heel region and said supporting member flexes toward said first member to thereby cushion said heel region.

18. An orthopedic shoe as in claim 17, wherein said wedge is fixed.

19. An orthopedic shoe as in claim 17, wherein said substantially rigid first member is a rigid resin and stabilizer plate.

20. An orthopedic shoe as in claim 17, wherein said substantially flexible supporting member is a flexible resin spring plate.

21. An orthopedic shoe as in claim 17, wherein said fastener comprises at least one bolt.

22. An orthopedic shoe as in claim 17, wherein said fastener comprises at least one rivet.

23. An orthopedic shoe as in claim 17, wherein said reinforcing member is a sole wedge.

24. An orthopedic shoe as in claim 17 wherein said substantially rigid first member comprises a plastic resin renforced with a plurality of fabric layers.

25. An orthopedic shoe as in claim 24, wherein said reinforced plastic resin comprises a vinyl ester resin and said reinforcing fabric layers comprise a material taken from the group consisting of graphite and glass fibers.

26. An orthopedic shoe as in claim 17, wherein said substantially flexible supporting member comrises a plastic resin reinforced with a plurality of fabric layers.

27. An orthopedic shoe as in claim 26, wherein said reinforced plastic resin comprises a vinyl ester resin and said reinforcing fabric layers comprise a material taken from the group consisting of graphite and glass fibers.

28. An orthopedic shoe as in claim 17, wherein said wedge comprises a plastic resin reinforced with a plurality of fabric layers.

29. An orthopedic shoe as in claim 28, wherein said reinforced plastic resin comprises a vinyl ester resin and said reinforcing fabric layers comprise a material taken from the group consisting of graphite and glass fibers.

30. An orthopedic shoe as in claim 17, wherein said wedge-shaped reinforcing member comprises a plastic resin reinforced with a plurality of fabric layers.

31. An orthopedic shoe as in claim 30, wherein said reinforced plastic resin comprises a vinyl ester resin and said reinforcing fabric layers comprise a material taken from the group consisting of graphite and glass fibers.

32. An orthopedic shoe as in claim 17, further comprising a heel mounted on said first member.

* * * * *